US005676055A

United States Patent [19]

Schwinn et al.

[11] Patent Number: 5,676,055

[45] Date of Patent: Oct. 14, 1997

[54] CONTROL DEVICE FOR A PRINTING MACHINE

[75] Inventors: Klaus Schwinn, Heusenstamm; Hartmut Leichnitz, Muhlheim/Main; Albrecht Volz, Rodermark, all of Germany

[73] Assignee: MAN Roland Druckmaschinen AG

[21] Appl. No.: 572,579

[22] Filed: Dec. 14, 1995

Related U.S. Application Data

[63] Continuation of Ser. No. 293,392, Aug. 19, 1994, abandoned.

[30] Foreign Application Priority Data

Aug. 19, 1993 [DE] Germany ..... 43 27 848.5

[51] Int. Cl.[6] ..... B41F 5/00; B41F 33/12

[52] U.S. Cl. ..... 101/216; 101/DIG. 41

[58] Field of Search ..... 101/181, 248, 101/183, 136, 137, 138, 141, 174, 184, 216, 219, DIG. 41

[56] References Cited

U.S. PATENT DOCUMENTS 4,951,567 8/1990 Rodi et al. .
5,013,981 5/1991 Rodi ..... 318/67

FOREIGN PATENT DOCUMENTS 0 243 728 B1 4/1987 European Pat. Off. .
35 41 277 A1 5/1987 Germany .
36 14 979 A1 11/1987 Germany .

OTHER PUBLICATIONS

DE–Prospekt: Siemens, Nr. E319, Regelsysteme, E31 Information, Antriebs–und Regleungstechnik (Modulpac C), Seite 7.

*Primary Examiner*—J. Reed Fisher
*Attorney, Agent, or Firm*—Leydig, Voit & Mayer, Ltd.

[57] ABSTRACT

This invention describes a control mechanism for an electric main drive of a printing machine, whereby the electric main drive operates with a motor, a brake and a tachometer generator. The machine control of the control mechanism is connected to a multiplicity of signal transmitters (pushbuttons). The signal transmitters detect the machine state to ensure that the printing machine does not run at an excessively high speed. For this purpose, the invention outlines, in addition to the machine control, a monitoring device which detects the switching states of the signal transmitters, forms a highest possible permitted speed therefrom and compares this value with the actual speed value delivered by the tachometer generator. The electric main drive is shut down as soon as the actual speed value overshoots this upper limit.

20 Claims, 6 Drawing Sheets

FLOW CHART TO INITIALIZE MONITORING DEVICE

CONTROL DEVICE FOR A PRINTING MACHINE

This is a continuation of application Ser. No. 08/293,392 filed on Aug. 19, 1994, now abandoned.

TECHNICAL FIELD

The invention relates to a control mechanism for a printing machine, and more particularly, to the control of the speed of the printing machine.

BACKGROUND OF THE INVENTION

Control mechanisms for printing machines are designed with several goals in mind. First, the printing machine should operate in a safe manner. This may be accomplished using various components such as brakes and control electronics. Second, the printing machine should operate in a manner which will minimize mechanical stress on the machine. This may be accomplished by designing a control mechanism to monitor the components of the printing machine so that the components are operating within designed parameters.

The basic structure of a printing machine, in particular a sheet-fed offset press, contains a main drive and an electronic control mechanism, as disclosed in U.S. Pat. No. 4,951,567, which is hereby incorporated by reference. Normally, the main drive contains three components: (1) an electric main drive; (2) an electromechanically operable brake; and (3) a tachometer generator. The three components of the main drive perform two primary functions, driving and braking. The electric main drive typically contains a DC motor for driving the printing machine. The brake assigned to the motor is controlled by the control mechanism to alternatively provide a normal shut-down of the printing machine or an emergency stop. The tachometer generator feeds to the electric main drive the value of the actual speed of the motor. The electric main drive subsequently supplies the motor with current in such a way that the actual speed of the motor agrees with a desired value prescribed by the control mechanism of the printing machine.

The second component of the printing press, the electronic control mechanism, can be designed as one or more computers. The control mechanism has three components: (1) input sensors; (2) processing electronics; and (3) output electronics. Input sensors are used in the control mechanism to monitor the state of printing machine. Normally, the control mechanism determines the desired maximum speed which is determined based on the particular state of the printing machine. For example, various operating states such as "crawl speed" (a very slow motion of the machine), "jog forwards" (a motion at an angle in the forward direction), and "jog backwards" (a motion at an angle in the opposite direction) can be monitored by the control mechanism based on the states of the signal transmitters. For the desired state, conventional control mechanisms do not provide for redundancy in controlling the operations of the printing machine or in stopping the printing machine when the speed of the printing machine exceeds the highest permitted speed.

SUMMARY OF THE INVENTION

It is a general object of the invention to provide a control mechanism for a printing machine which will provide for safer operation of the printing machine through redundant controlling of the printing machine to determine the state the machine is in, redundant checking of the highest permitted speed of that state, and redundant shutting off the printing machine when the speed of the machine exceeds the highest permitted speed.

It is a related object of the invention to provide a control device which monitors the components of the printing machine and shuts off the machine when an anomaly is detected.

It is a further related object of the invention to provide a control device which decreases the stress on the brake by operating the brake only in emergency stop situations.

The present invention accomplishes these objectives and overcomes the drawbacks of the prior art by providing for a control mechanism for a printing machine which more effectively monitors the speed of the machine and monitors the individual components of the machine. In the present invention, the control mechanism is divided into two separate devices, the monitoring device and the control device.

Both the control device and the monitoring device check whether the printing machine is operating below the maximum permitted speed. The control device determines the highest permissible speed and shuts off the machine if the printing machine is operating at a speed higher than the maximum speed.

The monitoring device also monitors the speed of the printing machine to determine if the machine is operating below the maximum permitted speed. The monitoring device continuously senses the state of the printing machine via the signal transmitters. A multiplicity of signal transmitters are mounted onto the printing machine and may be comprised of electromechanical pushbuttons which indicate the particular operating state. A highest permitted speed of the main drive is stored for each possible machine state in the control mechanism. The monitoring device compares the highest permitted speed with the speed of the motor as determined from the output of the tachometer generator. If the actual value of the speed of the motor is below the value of the permitted speed, the monitoring device does not perform any sort of intervention in the electric main drive. If in a specific operating state the monitoring device determines that the actual speed of the motor is higher than the maximum speed permitted in this state, then for example the main drive is immediately shut down via the corresponding main protection and the brake is operated.

However, the monitoring device is a system which operates independently of the control device. First, the monitoring device allows for redundant control of the printing machine. Both the monitoring device and the control device have separate bus systems to monitor the signal transmitters of the printing machine independently. The monitoring device can thus detect not only faults in the main drive electronics, but also faults in the control upstream of the main drive electronics. Second, the monitoring device provides for a redundant shut off of the printing machine. In a first way, the control device is connected in series with the monitoring device so that when a quick stop or normal stop command is entered, both the devices can independently shut off the printing machine. In a second way, the monitoring device and the control device can independently operate the brake and cut off the power to the main drive.

In essence, the monitoring device provides for a redundant determination of the highest permissible speed of the printing machine independent of control device. Therefore, the monitoring device increases the reliability of the control mechanism in the event that there is an error in the control device.

Moreover, the monitoring device provides for increased reliability of the control mechanism through control electronics which determine whether various components of the printing machine are functioning properly. With regard to the main drive, the monitoring device checks the tachometer after a stop command is entered to determine if the speed of the motor is decreasing. If the speed is not decreasing, the control electronics determines that there is an error in the main drive. Thus, the monitoring device turns off the printing machine by operating the brake and by shutting off the power to the main drive. Moreover, the monitoring device continuously monitors the tachometer to determine if a signal is being sent. In the event that a valid signal is not received from the tachometer, the monitoring device determines that there is an error and shuts off the machine. Further, the monitoring device examines the operations of the motor to determine that in the event of a failure of one of the devices, the printing machine is shut off. Thus, the printing machine can more safely operate based on the control system monitoring the different operating states of the printing machine.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 1:
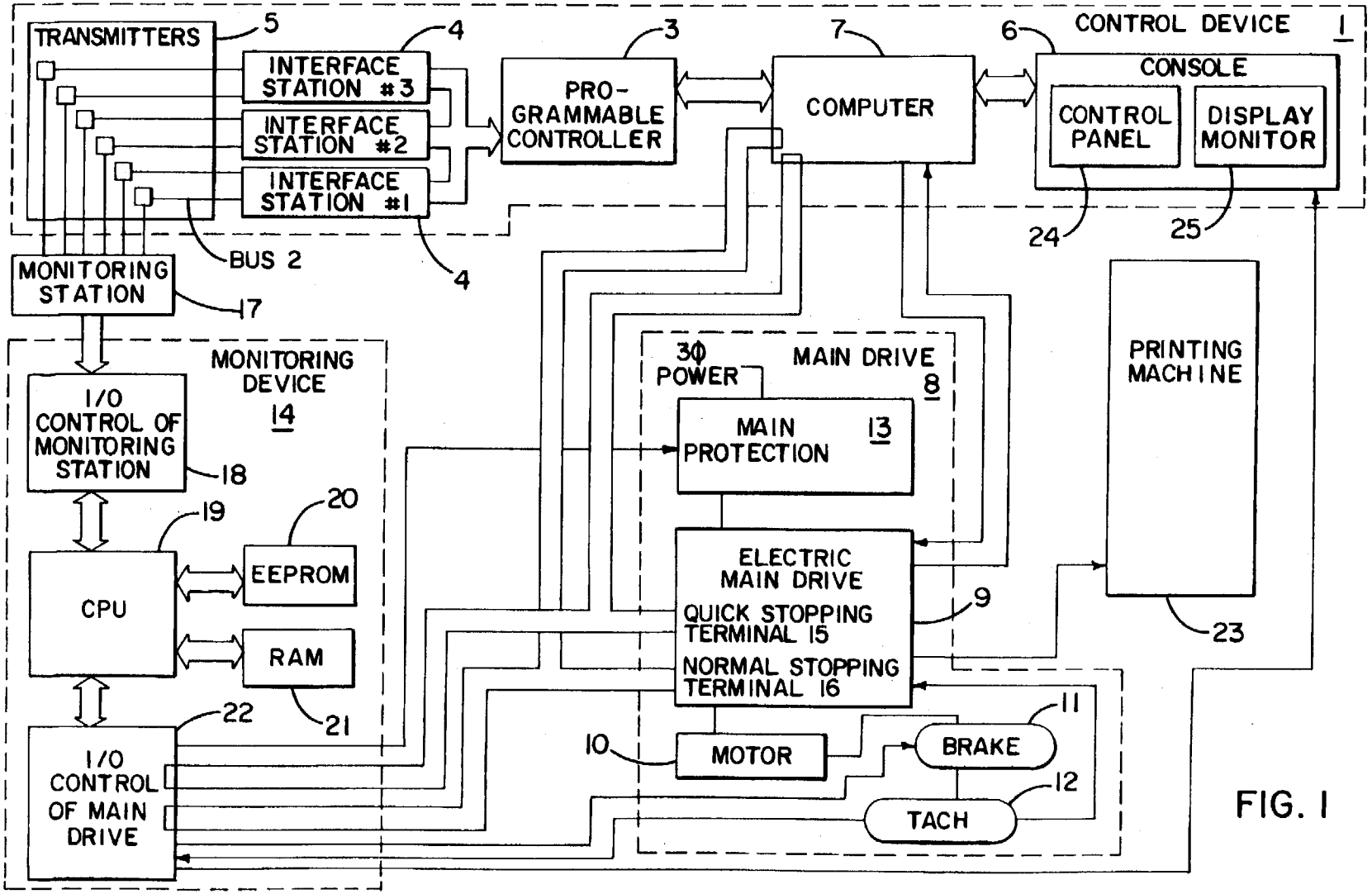
FIG. 1 is a block diagram of the control mechanism according to the invention.

FIG. 1 represents the principle of the structure of the control device 1. The machine control 3 is connected to a control bus 2 in the form of a programmable controller (PC), which is operationally connected via PC stations 4 likewise connected to the control bus 2. The individual PC stations 4 are connected to the signal transmitters 5, with the result that their operating state is communicated to the machine control 3 via the control bus 2.

In a known way, the signal transmitters 5 are pushbuttons, emergency stop switches and protective relays which are mounted, for example, on folding steps or sliding guards. The signal transmitters can also, however, be constructed as sensors or the like which detect the machine state.

Furthermore, the console 6 of the printing machine 23 is coupled to the control bus 2. The console 6 of the printing machine 23 is a computer which is accommodated in the control desk of the printing machine 23 and has a control panel 24 together with a display monitor 25. Consequently, commands can also be fed to the machine control 3 via this control panel 24 of the console 6. An emergency stop pushbutton is also present on the console 6.

Also coupled to the control bus 2 is computer 7 which undertakes to transfer signals and commands between the machine control 3 and the main drive 8 of the printing machine 23. The computer 7 relays the commands sent to the main drive 8 from the machine control 3 in accordance with the interface protocol of the electric main drive 9. A similar statement holds for the checkback signals of the electric main drive 9 to the machine control 3 which indicate the status of the electric main drive 9.

The main drive 8 comprises the electric main drive 9 (power converter), the motor 10, which is constructed, in particular, as a DC motor, the brake 11, which is connected to the motor 10, and the tachometer generator 12. The tachometer generator 12 is electrically connected to the electric main drive 9, and in addition the brake 11 is also switched directly from the electric main drive 9. The electric main drive 9 can be an AC/DC-converter with converter valves (thyristors) whereby the valves are controlled by the computer for generating a given DC voltage (phase control). The electric main drive 9 controls the current supply of the motor 10 in accordance with a prescribed desired speed value. A main protection 13, via which the electric main drive 9 can be disconnected from the mains, is connected upstream of the electric main drive 9.

Figure 2:
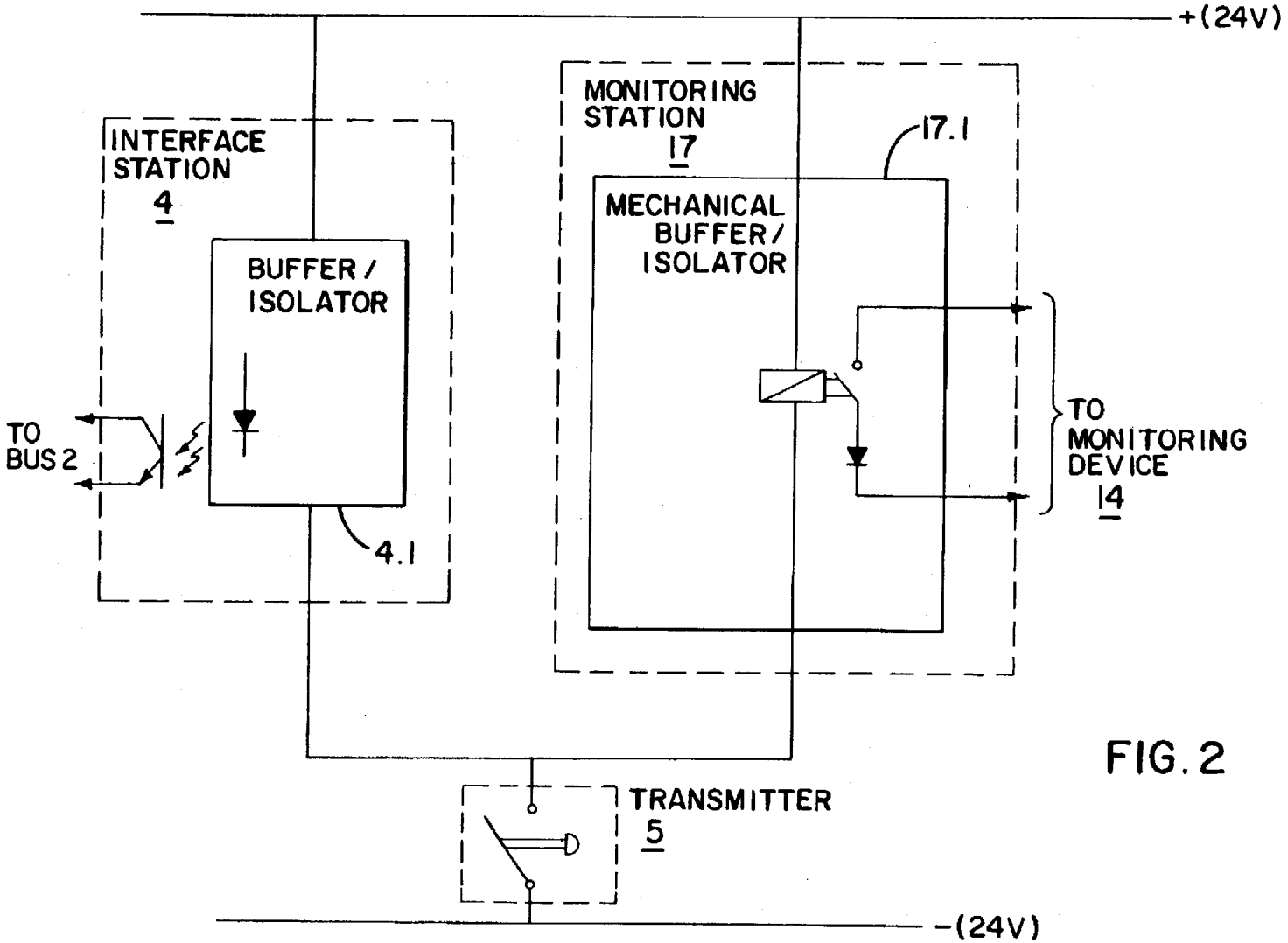
FIG. 2 is an illustration of the interfacing of the signal transmitters with the monitoring device.

Each individual signal transmitter 5 is connected to the monitoring device 14 in a way shown in more detail in FIG. 2. In this case, the monitoring device 14 is designed as a computer whereby the monitoring device has input and output stations 18, 22, a central processing unit 19, and storage devices 20, 21.

Furthermore, the monitoring device 14 is connected to the brake 11, the tachometer generator 12, and the main protection 13 as well as the quick-stopping terminal 15 and the normal-stopping terminal 16 of the electric main drive 9. The monitoring device 14 is thus able to shut down the electric main drive 9 via the main protection 13, thereby shutting down the motor 10.

Figure 3:
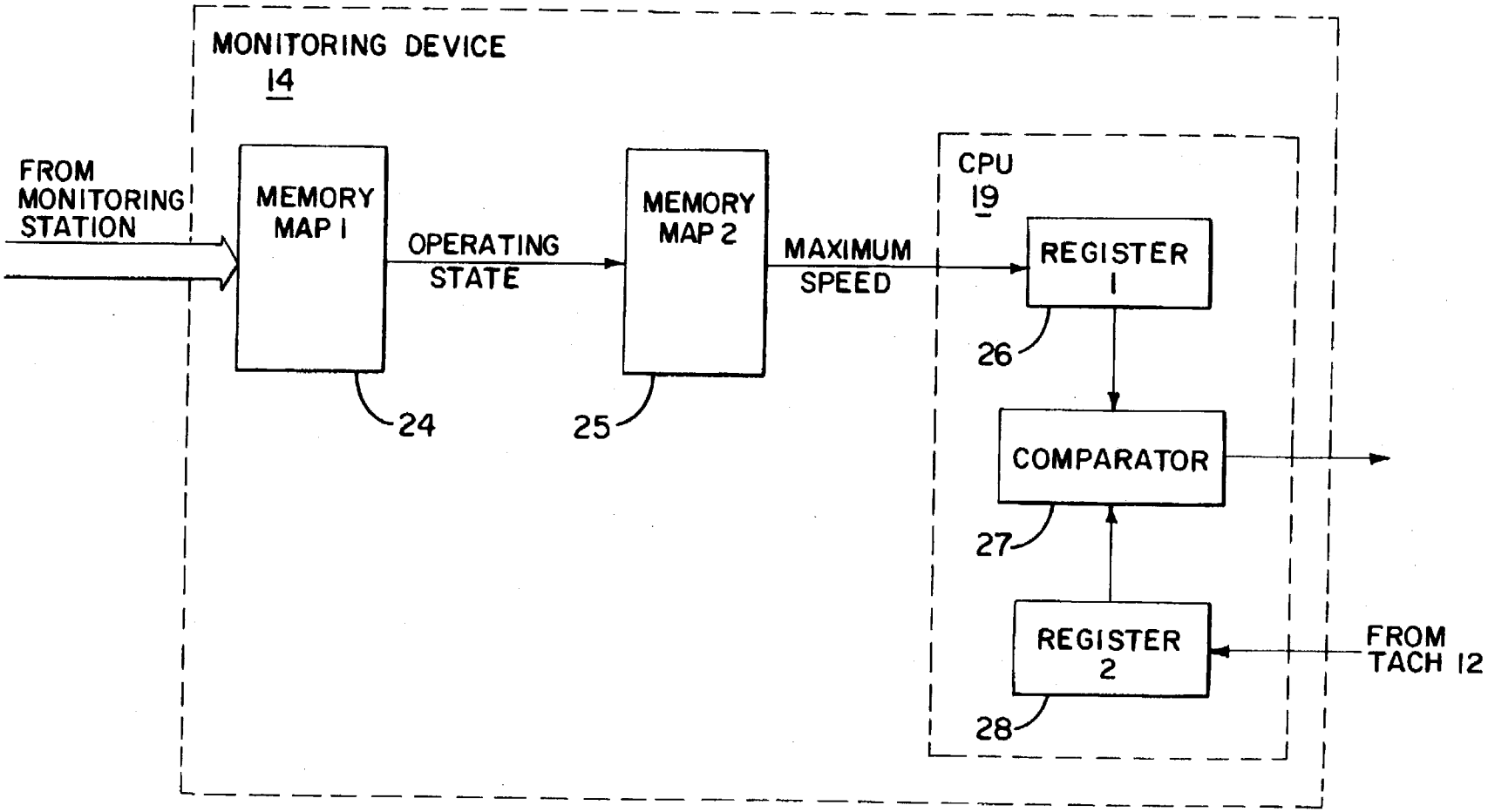
FIG. 3 is a block diagram of the electronics of the monitoring device when checking the maximum speed of the printing machine.

The central processing unit (CPU) 19 of the monitoring device 14 continuously detects the switching states of the signal transmitters 5 via the monitoring station 17 and determines therefrom a correspondingly permitted maximum speed for the motor 10. As shown in FIG. 3, the monitoring device 14 determines the state of memory maps of the printing machine through the memory map1 24. Memory map1 24 acts as a look-up table whereby the inputs from the monitoring station 17 access the memory location which contains the state of the printing machine 23 associated with the corresponding inputs. Thus, the output of memory map1 24 contains the operating state of the printing machine based on the inputs from the monitoring station 17. Memory map2 25 accepts the operating state as an input and also acts as a look-up table. The operating state accesses the memory location which contains the maximum permitted speed for that operating state. The maximum permitted state is sent to register1 26. The output of the tachometer generator 12, which senses the speed of the motor 10, is sent to register2 28.

The CPU 19 compares the two numbers in register1 26 and register2 28 via a comparator 27. If the comparator 27 determines that the actual speed of the motor 10 detected via the tachometer generator 12 in register2 28 is below the respectively permitted maximum speed as shown in register1 26, no measure is performed by the monitoring device 14. This measure accounts for the circumstance that a printing machine running too slowly represents no danger to an operator. If the comparator 27 determines that the actual speed of the motor 10 as shown in register2 28 is greater than the maximum permitted speed for the operating state as shown in register1 26, the comparator 27 sends a command to shut down the electric main drive 9 directly via the main protection 13, and to operate the brake 11.

Further, the monitoring device can execute braking operations in other specific states via the quick-stopping terminal 15 or the normal-stopping terminal 16. When the quick stopping terminal 15 is opened, the electric main drive 9 controls the motor 10 as a generator. The brake 11 is not actuated. The current produced by the motor 10 is regulated on the highest possible value. The speed of the machine decreases as fast as possible. The brake 11 will be actuated when the printing machine 23 is stopped. When the normal stopping terminal 16 is opened, the electric main drive 9 controls the motor also as a generator. The brake 11 is not actuated. The printing machine 23 is braked by the electric main drive 9 which controls the current produced by the motor 10 so that the speed of the motor 10 decreases according to a stored time ramp. The time ramp is stored in the electric main drive 9. The brake 11 will be actuated when the printing machine 23 is stopped.

In accordance with the representation in FIG. 1, the monitoring device 14 additionally monitors the correctness of the commands transmitted by the computer 7 to the electric main drive 9. The monitoring device 14 compares the speed of the motor 10, as sent from the tachometer generator 12, with the command sent from the computer 7 to the electric main drive 9. The monitoring device 14 is also switched into the control bus 2, with the result that a measure undertaken by the monitoring device 14 of stopping the machine by the main drive 8 and the brake 11 can be displayed in the console 6.

As indicated in FIG. 2, each signal transmitter 5 is coupled to the control bus 2 via a card 4.1 in a PC station 4. The cards 4.1 in the PC stations 4 are in this case advantageously designed using withdrawable-unit technology and accommodated correspondingly in a control cabinet. Provided in parallel with each PC station 4 is a monitoring station 17 which receives the signals of a group of signal transmitters 5 in parallel with the PC station 4. A signal transmitter 5 constructed as a pushbutton is constructed in this case as a so-called positively-driven break contact. If such a pushbutton is operated, a voltage drop is produced both in the card 4.1 of the PC station 4 and in the card 17.1 of the monitoring station 17, with the result that a relay provided on the card 17.1 opens a switch connected thereto. It can thus be determined between two terminals of a card 17.1 whether the pushbutton of the signal transmitter 5 is being operated or not.

Finally, it remains to explain the function of the monitoring device 14 in conjunction with the machine control 3. For example, if an emergency stop pushbutton has been operated, this is communicated via a PC station 4 and the control bus 2 and machine control 3. The machine control 3 now generates a command to open the quick-stopping terminal 15, and this is effected by the computer 7.

Since, through the signal transmitters 5, the emergency stop pushbutton simultaneously communicates via the monitoring station 17 of the electric monitoring device 14 that the emergency stop pushbutton has been operated, the latter likewise opens the quick-stopping terminal 15 on the electric main drive 9. The electric connections for the quick-stopping terminal 15, and likewise for the normal-stopping terminal 16, are correspondingly connected through in series by the computer 7 and the monitoring device 14.

The opening of the quick-stopping terminal 15 both by the computer 7 and by the monitoring device 14 has the effect in the normal case that the signal of the tachometer generator 12 drops in accordance with a very steep time law. This time law is stored in the monitoring device 14. If the monitoring device 14 determines that this is not the case, the monitoring device 14 opens the main protection 13 and thus shuts down the electric main drive 9. The brake 11 is also operated at the same time.

The monitoring device 14 constructed according to the invention not only monitors the actual speed of the motor 10 by comparison with the highest possible permissible speed, but also determines whether there is a defect in the tachometer generator 12. For this purpose, the motor 10 and brake 11 are connected to the electric main drive 8 in such a way that supplying power to the motor 10 simultaneously opens the brake 11. The consequence of this is that during the time when the motor 10 is supplied with power, the tachometer generator 12 also always emits a signal. If this is not the case, it is to be assumed that the tachometer generator 12 is defective so that the monitoring device 14 opens the main protection 13 and operates the brake 11.

The monitoring device 14 constructed in accordance with the invention need not, as in the exemplary embodiment described, carry out only monitoring of the actual speed of the motor 10 as a function of the machine state, but can also, in the way described, monitor other drives, for example in the feeder or taker or auxiliary drives for positioning the printing machine (switching over from printing recto to printing recto and verso). The monitoring device 14 does not carry out speed monitoring in the sense of comparing the actual speed with a highest permissible speed, but merely determines whether the corresponding drive or drives are shut down given specific switching states of the signal transmitters 5 (for example, an emergency stop pushbutton is activated).

Figure 4:
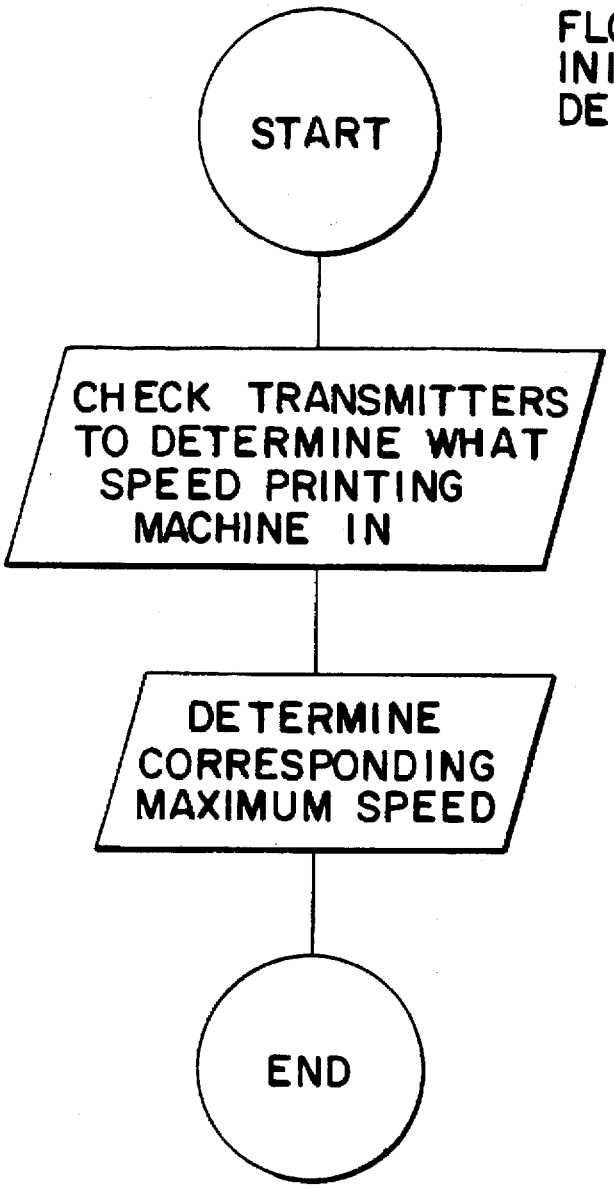
FIG. 4 is a flow diagram of the programming to initialize the monitoring device.
Figure 5A:
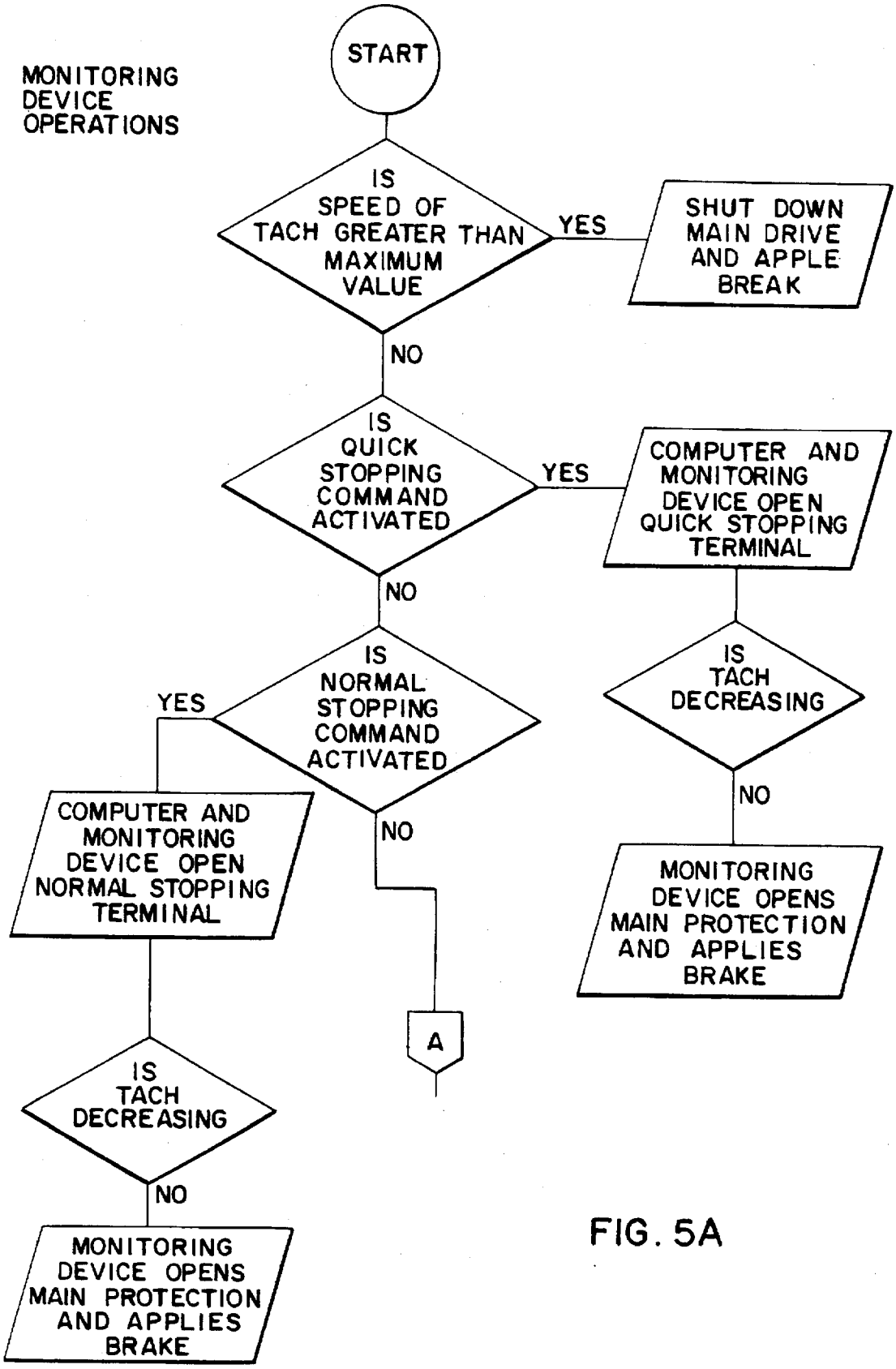
FIG. 5 is a flow diagram of the programming of the monitoring device to control the printing machine.
Figure 5B:
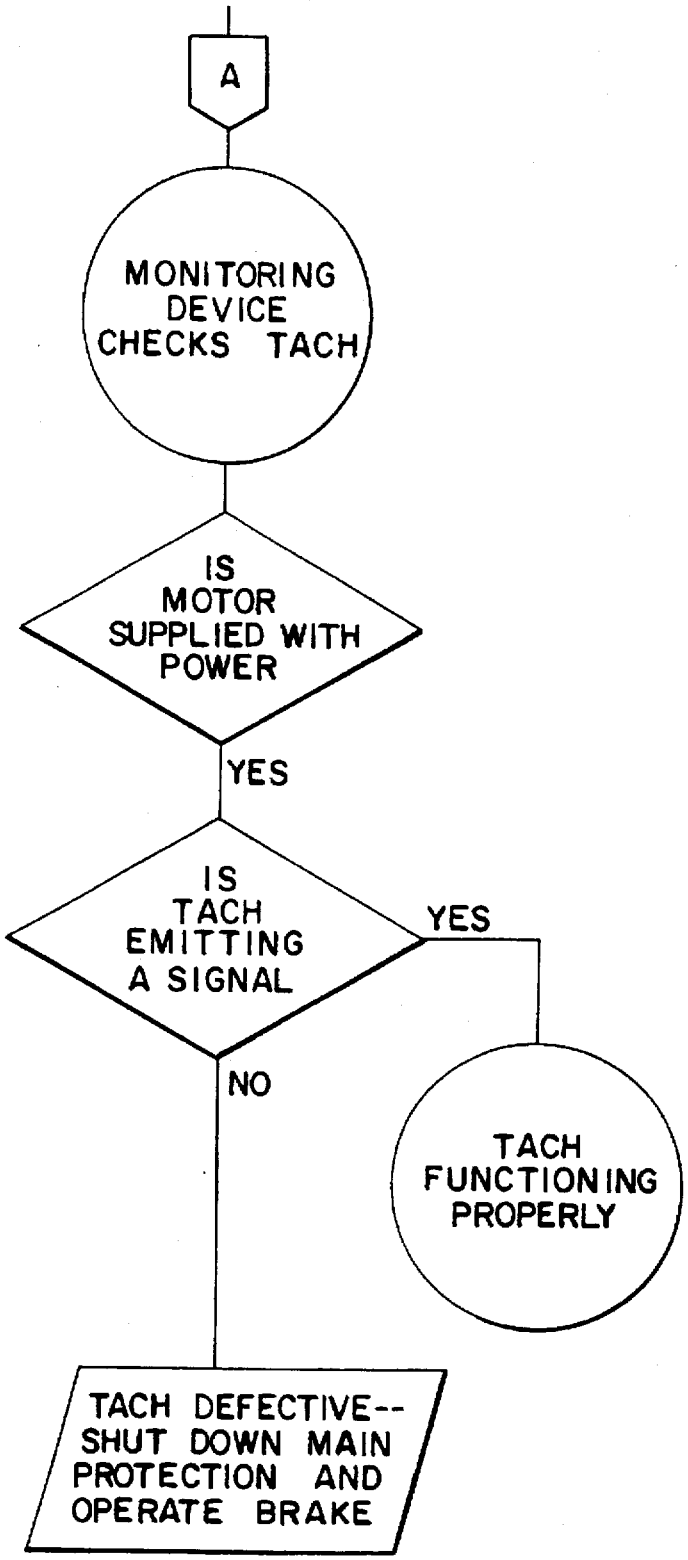

FIGS. 4 and 5 are flow diagrams which detail the programing of the monitoring device in terms of initialization and in terms of controlling the printing machine. The flow diagrams follow the operation of the monitoring device as outlined previously in the specification.

What is claimed is:

1. An apparatus for controlling an operating speed comprising: a printing press having multiple operating states; a motor for driving the printing press; a tachometer for sensing the operating speed of the motor; a braking mechanism for stopping the motor; and a control system, the control system comprising: an input means comprising at least one sensor which is independent of operator input for providing input signals indicating an operating state of the printing press; a controller electrically connected to the sensor for receiving input signals from the sensor and for generating control signals corresponding thereto; a driver associated with the motor and connected to the controller for supplying electrical current to the motor at levels corresponding to the operating state of the printing press; a monitoring device responsive to the input signals from the sensor for determining a maximum permitted speed independent of operator input; the monitor device including a look-up table containing the operating states of the printing press, where each of the operating states is associated with a value for the maximum permitted speed; and the monitoring device being connected to the tachometer and to the driver for stopping the current supplied to the motor when the speed of the motor exceeds the maximum permitted speed.

2. An apparatus for controlling an operating speed as defined in claim 1 wherein the input means comprises at least one switch for indicating the operating state of the printing press.

3. An apparatus for controlling an operating speed as defined in claim 1 wherein the input means comprises sensors for detecting the operating state of the printing press.

4. An apparatus for controlling an operating speed as defined in claim 1 wherein the monitoring device interrogates the input means cyclically to determine the operating state of the printing press.

5. An apparatus for controlling an operating speed as defined in claim 1 further comprising a main circuit breaking means for selectively preventing current flow to the driver.

6. An apparatus for controlling an operating speed as defined in claim 5 wherein the monitoring device is connected to the main circuit breaking means, the monitoring device selectively triggering the main circuit breaking means to prevent current flow to the driver.

7. An apparatus for controlling an operating speed as defined in claim 1 further comprising a first bus system connecting the controller and the input means, and a second bus system connecting the monitoring device and the input means.

8. An apparatus for controlling an operating speed as defined in claim 1 wherein the monitoring device is connected to the braking mechanism of the printing press, the monitoring device activating the braking mechanism when the speed of the motor exceeds the maximum permitted speed.

9. An apparatus for controlling an operating speed as defined in claim 1 wherein the driver further comprises a quick stopping terminal for stopping the flow of current to the motor at a first rate and a normal stopping terminal for stopping the flow of current to the motor at a second rate, the first rate being faster than the second rate.

10. An apparatus for controlling an operating speed as defined in claim 9 wherein the quick stopping terminal and the normal stopping terminal are each coupled to the monitoring device.

11. An apparatus for controlling an operating speed as defined in claim 10 wherein the quick stopping terminal and the normal stopping terminal are each coupled to the controller.

12. An apparatus for controlling an operating speed as defined in claim 10 wherein the quick stopping terminal is connected to the monitoring device, the monitoring device triggering the braking mechanism when the quick stopping terminal is activated and the tachometer indicates the motor speed is not decreasing.

13. An apparatus for controlling an operating speed as defined in claim 10 wherein the normal stopping terminal is connected to the monitoring device, the monitoring device triggering the braking mechanism when the normal stopping terminal is activated and the tachometer indicates the motor speed is not decreasing.

14. An apparatus for controlling an operating speed as defined in claim 11 wherein the input means includes an emergency stop switch for generating a stopping signal and wherein the controller and the monitoring device trigger the quick stopping terminal of the driver in response to the stopping signal.

15. An apparatus for controlling an operating speed as defined in claim 6 wherein the monitoring device is connected to the braking mechanism, the monitoring device triggering the main circuit breaking means when the brake is released and the tachometer indicates the motor is not rotating.

16. An apparatus for controlling an operating speed as defined in claim 1 wherein the controller and the monitoring device are connected such that one of the control signals generated by the controller is received by the monitoring device and the driver.

17. An apparatus for controlling an operating speed as defined in claim 1 wherein the motor and the driver are a first motor and a first driver respectively, and the monitoring device monitors a second driver of a second motor in the printing press.

18. An apparatus for controlling an operating speed comprising: a printing press having multiple operating states; a motor for driving the printing press; a tachometer for sensing the operating speed of the motor; a braking mechanism for stopping the motor; and a control system, the control system comprising: an input means comprising at least one sensor which is independent of operator input for inputting signals indicating the operating state of the printing press; a drive circuit coupled to the sensor and the motor for selectively supplying a predetermined level of current to the motor, the predetermined level of current being determined by the operating state of the printing machine, the drive circuit including a quick stopping terminal for reducing the current supplied to the motor at a first rate and a normal stopping terminal for reducing the current supplied to the motor at a second rate, the first rate being faster than the second rate; a selectively activated circuit breaking means for stopping current flow to the drive circuit; and a monitoring device coupled to the sensor, the drive means, the selectively activated circuit breaking means, the tachometer and the braking mechanism, the monitoring device responsive to the signals from the sensor for determining a maximum permitted speed therefrom independent of operator input, the monitoring device including a look-up table containing the operating states of the printing press, where each of the operating states is associated with a value for the maximum permitted speed, the monitoring device comparing the speed of the motor indicated by the tachometer to the maximum permitted speed and triggering the quick stopping terminal to stop current flow to the motor if the maximum permitted speed is exceeded, the monitoring device activating the braking mechanism and the selectively activated circuit breaking means if the tachometer indicates the speed of the motor is not decreasing after the quick stopping terminal has been triggered.

19. An apparatus for controlling an operating speed as defined in claim 18 further comprising a control circuit coupled to the input means and the drive circuit, the control circuit providing the drive circuit with control signals setting the predetermined level of current to be supplied to the motor.

20. An apparatus for controlling an operating speed comprising: a printing press having multiple operating states; a motor for driving the printing press; a tachometer for sensing the operating speed of the motor; a braking mechanism for stopping the motor; and a control system, the control system comprising: at least one sensor which is independent of operator input for providing input signals indicating an operating state of the printing press; a controller electrically connected to the sensor for receiving input signals from the sensor and for generating control signals corresponding thereto; a driver associated with the motor and connected to the controller for supplying electrical current to the motor at levels corresponding to the operating state of the printing press; a monitoring device responsive to the input signals from the sensor for determining a maximum permitted speed independent of operator input, the monitoring device continuously sensing the input signals, the monitoring device including a look-up table containing the operating states of the printing press, where each of the operating states is associated with a value for the maximum permitted speed; and the monitoring device being connected to the tachometer and to the driver for stopping the current supplied to the motor when the speed of the motor exceeds the maximum permitted speed.

* * * * *